US005794935A

United States Patent [19]

Lo

[11] Patent Number: 5,794,935

[45] Date of Patent: Aug. 18, 1998

[54] BRIGHTNESS ENHANCING STRIP AND MAT FOR GAME TABLES

[76] Inventor: Allen Kwok Wah Lo, 5022 Hidden Branches Dr., Dunwoody, Ga. 30338

[21] Appl. No.: 874,471

[22] Filed: Jun. 16, 1997

[51] Int. Cl.[6] ..... A63F 9/00

[52] U.S. Cl. ..... 273/309; 273/DIG. 24

[58] Field of Search ..... 273/148 R, 309, 273/274, DIG. 24; 108/90

[56] References Cited

U.S. PATENT DOCUMENTS

| | | | |
|---|---|---|---|
| 1,763,476 | 6/1930 | Morris | 273/309 |
| 2,113,049 | 4/1938 | Holland | 273/309 |
| 3,194,561 | 7/1965 | Schumann | 273/309 |
| 4,484,745 | 11/1984 | Sleeper | 273/309 X |
| 5,273,289 | 12/1993 | Morse | 273/309 X |
| 5,393,067 | 2/1995 | Paulsen et al. | 273/309 X |

*Primary Examiner*—William E. Stoll
*Attorney, Agent, or Firm*—Kenneth Q. Lao

[57] ABSTRACT

This disclosure is concerned with a brightness enhancing strip having a plurality of light reflecting facets for lining along the rims of a game table top. When one or more light sources located above the table top are used to illuminate the table top, some of light rays reaching the strips are reflected toward the center portion of the table top. Such strips are useful for enhancing the brightness of the game table and the game pieces that are placed facing the strips and away from the table rim. The brightness enhancing strips can also be integrated into a mat for lining a game table top.

7 Claims, 5 Drawing Sheets

BRIGHTNESS ENHANCING STRIP AND MAT FOR GAME TABLES

BACKGROUND OF THE INVENTION

In a Mahjong game or another tile game, a number of players are seated around a table to play with a set of game pieces or tiles. Each player is given a number of tiles and the objective of the game is for each of the players to assemble the tiles in the hand into a certain pattern by taking turns to exchange the tiles in the hand with those on the table. Usually, each player's tiles are placed in an upright position such that the face of the each tile is facing the player so as to allow the player to see the assembling pattern of the tiles in the hand and, at the same time, to conceal the face of the tiles from other players. When the game is played indoor or in the evening where natural lighting is not adequate, a light source placed above the table is usually used for illumination. On the tiles that face the players, however, such illumination does not produce desirable brightness because the tile's own shadow would cast over the face of each tile.

It is desirable to provide a simple means for enhancing the brightness on a game table to allow each of the players to see his or her own set of game pieces more clearly.

SUMMARY OF THE INVENTION

It is an objective of the present invention to provide a means for enhancing the brightness on a game table without using additional light sources.

It is another objective of the present invention to provide a means for enhancing the brightness on the game pieces facing the players which are seated around the game table.

It is yet another objective of the present invention to provide a simple means for enhancing the brightness on a game table with the enhancing means being non-intrusive and non-interfering.

The above objectives can be achieved by providing a plurality of brightness enhancing strips around the rim portion of a game table top. The brightness enhancing strip comprises a plurality of light-scattering or reflecting facets to direct light rays toward the center portion of the table top. When the strip is illuminated by one or more light sources located above the game table, it enhances the brightness on the game pieces that are placed away from the rim, facing the strip.

Preferably, the strips are thin and flat so as not to be too intrusive and interfering. The strips can be detachable from the table top, or they can be part of a mat that is placed on the table top.

The objectives of the present invention will become apparent upon reading the description of the drawing figures.

DETAILED DESCRIPTION OF THE INVENTION

Figure 1:
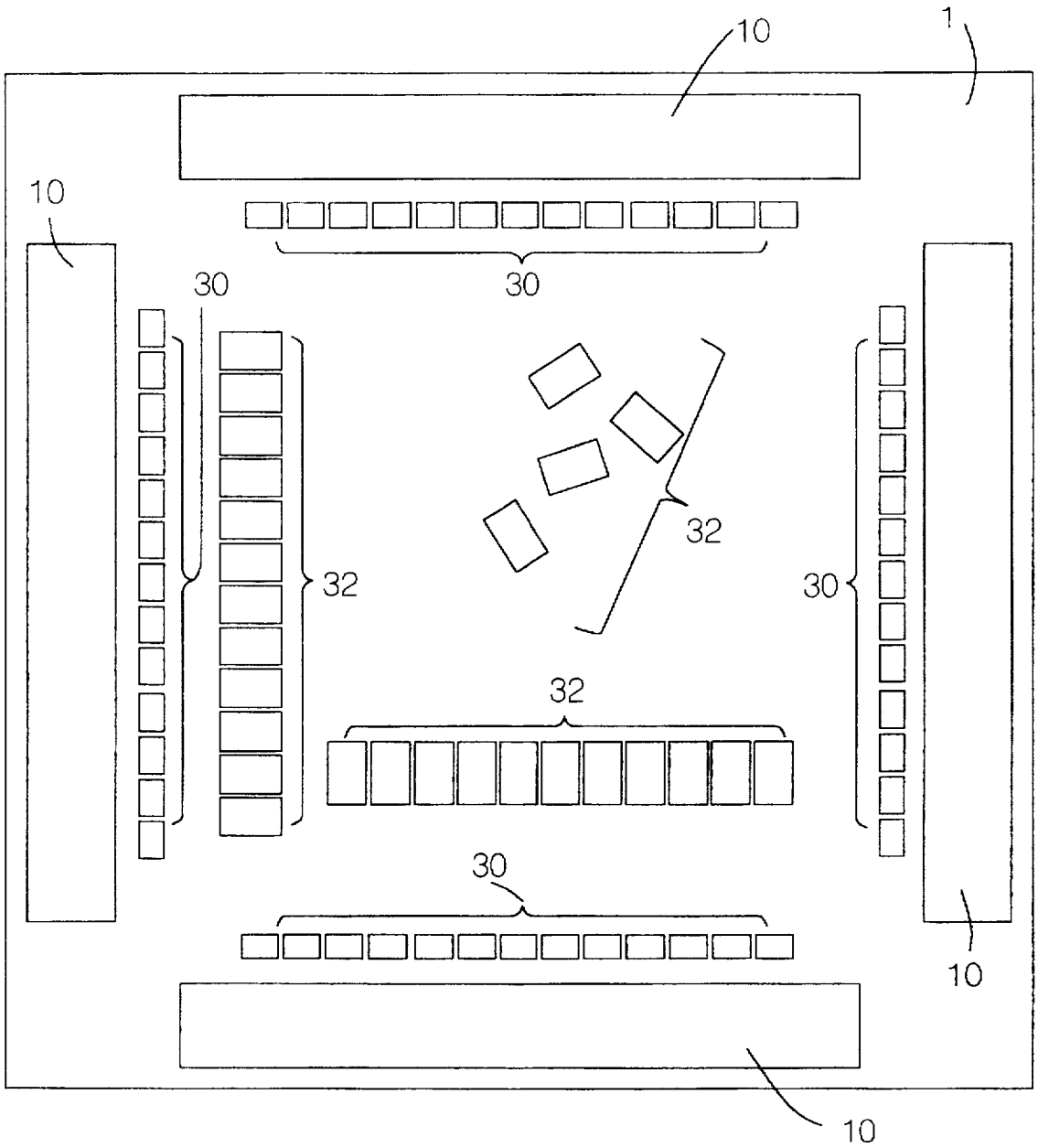
FIG. 1 shows the arrangement of a plurality of brightness enhancing strips around the rim portion of a game table top.

FIG. 1 shows the arrangement of a plurality of brightness enhancing strips around the rim portion of a game table top. In FIG. 1, numeral 1 denotes a square table top and numeral 10 denotes each of the four brightness enhancing strips disposed about the rim portion of the table top 1. Numeral 30 denotes the game pieces that are placed facing the brightness enhancing strips while numeral 32 denotes other game pieces on the table. The strips 10 should be sufficiently long so as to enhance the brightness on the entire row of game pieces 30 facing each strip. The strips may or may not be long enough to form an enclosed loop. Preferably, the strips 10 are narrow in width so as not to occupy too large an area of the table top. Also, preferably, the strips are sufficiently thin so as not to be intrusive or interfering.

Figure 2:
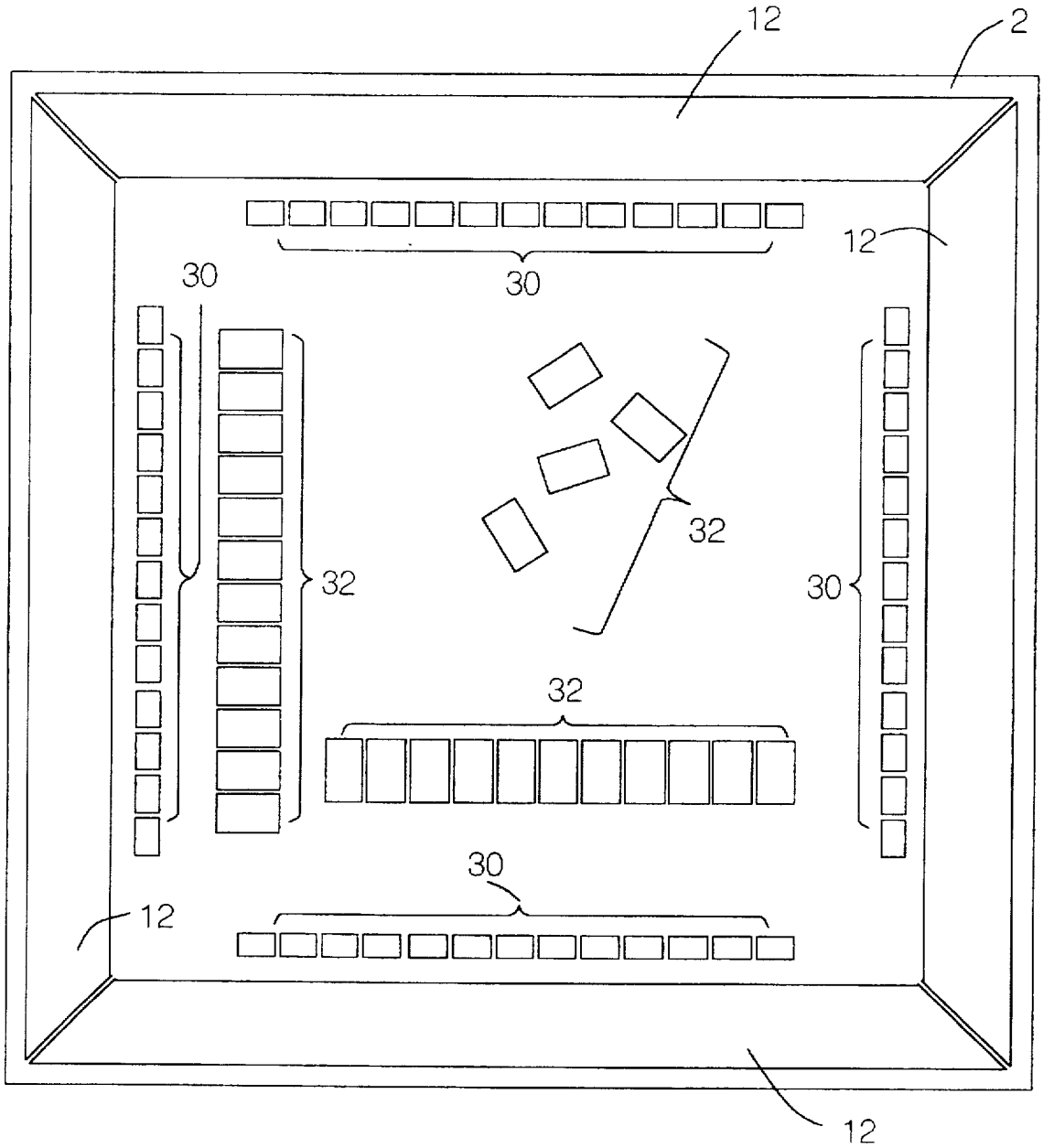
FIG. 2 shows another arrangement of the brightness enhancing strips around the rim portion of a game table top.

FIG. 2 shows another arrangement of the brightness enhancing strips around the rim portion of a game table top or a mat. In FIG. 2, numeral 2 denotes a mat to be used on a game table top, and numeral 12 denotes each of the four brightness enhancing strips disposed about the rim portion of the mat 2. As shown, the strips are sufficiently long to touch each other to form an enclosed loop. But they can be shorter. The strips can be detachable from the mat or they can be integral to the mat. Moreover, the strips can be narrow to cover only a portion of the surface area of the mat 2, but they can be wide to cover a large part of the mat or the entire surface area of the mat.

Figure 3:
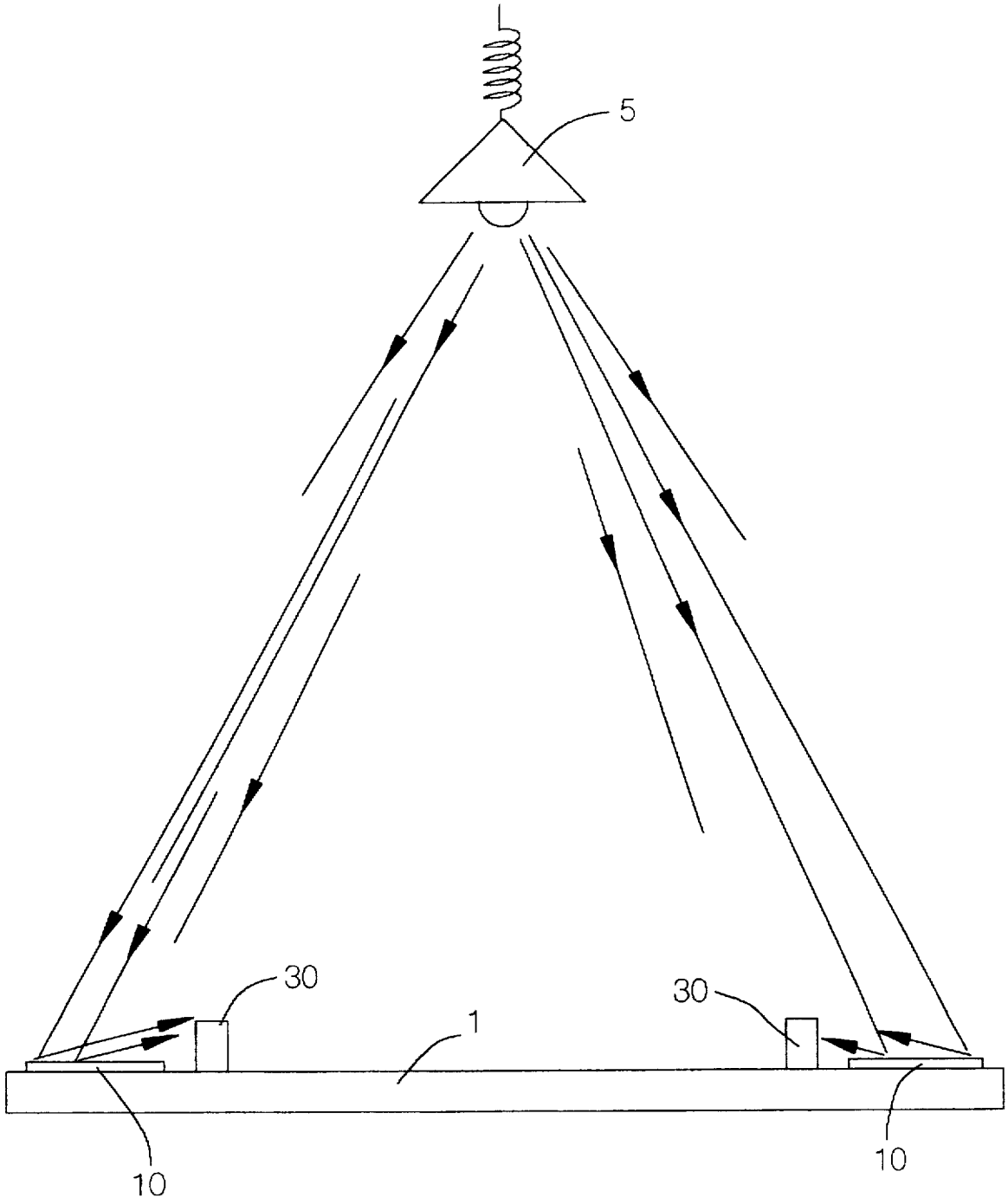
FIG. 3 shows the location of the brightness enhancing strips in relation to the illuminating light source.

FIG. 3 shows the location of the brightness enhancing strips in relation to the illuminating light source. FIG. 3 shows the side view of the table top 1 and the cross section of the brightness enhancing strips 10. One strip is placed along the left rim and one is placed along the right rim of the table. Numeral 30 denotes the game pieces that are placed near the rim portion of the table top, facing the strips 10. Numeral 5 denotes a light source located above the table top to provide illumination.

Figure 4:
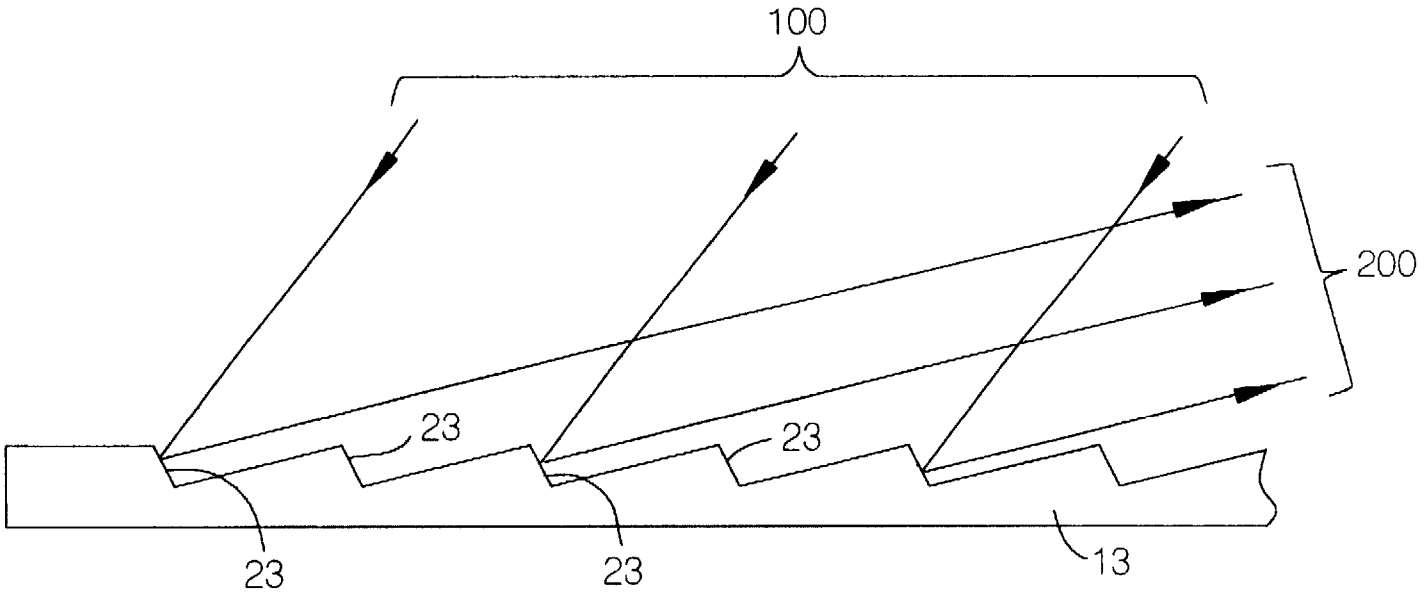
FIG. 4 illustrates a plurality of light reflecting facets distributed on the upper surface of a brightness enhancing strip.
Figure 5:
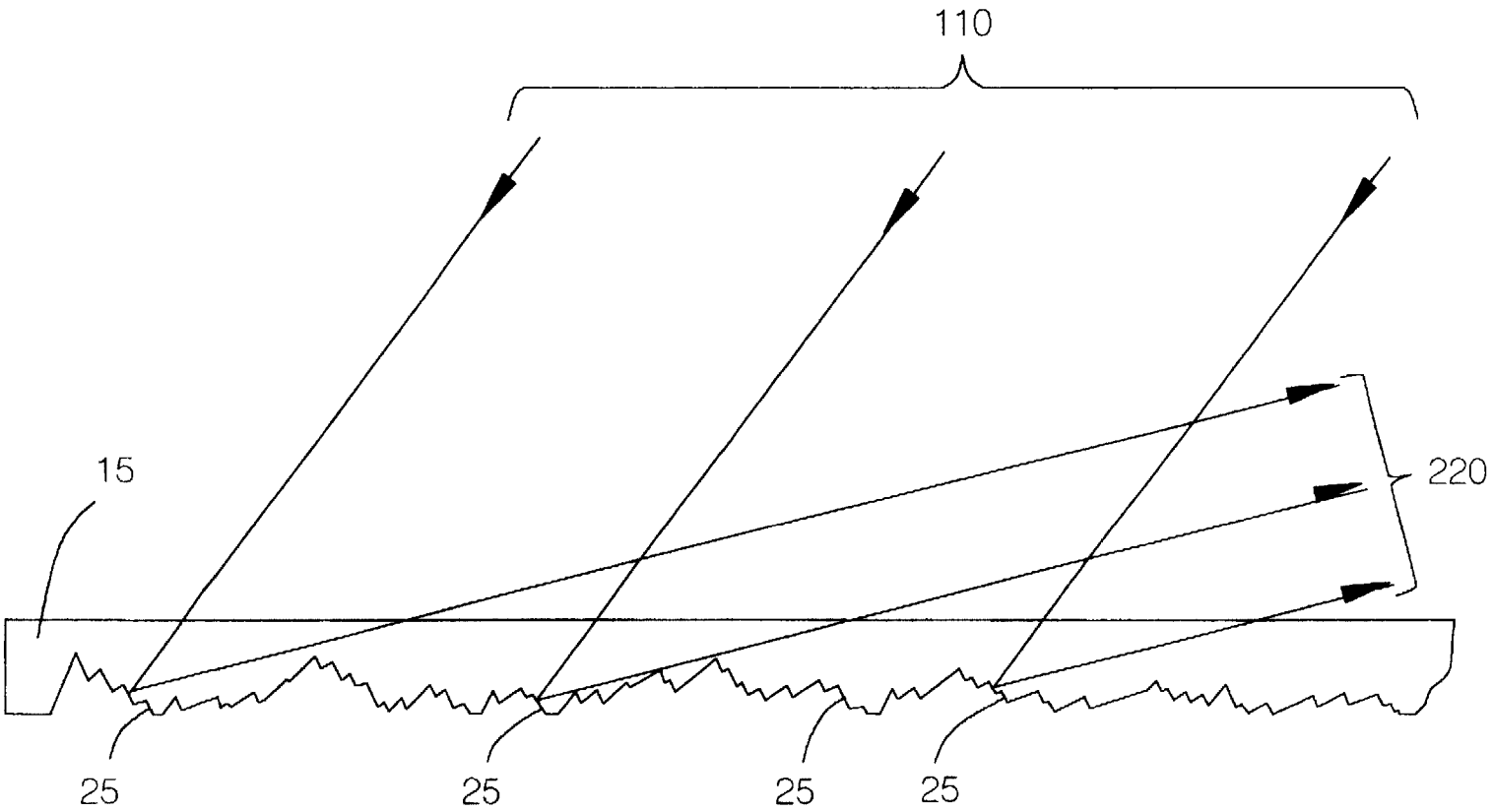
FIG. 5 illustrates a plurality of light reflecting facets distributed on the lower surface of a brightness enhancing strip.

FIG. 4 illustrates a plurality of light reflecting facets located on the upper surface of a brightness enhancing strip. FIG. 4 shows a cross section of a brightness enhancing strip 13 which can be a short strip like the strips 10 shown in FIG. 1 or a longer strip like the strips 12 shown in FIG. 2. The brightness enhancing strip 13 comprises an array of facets, collectively denoted by numeral 23, for reflecting light. As shown, light rays 100 descend upon the strip from the upper right corner as if the strip is placed along the left rim of the table top and is illuminated by a light source located above the center of the table. As the light rays reach the upper surface of the strip 13, some of the rays are reflected by the facets 23 and directed towards the right. The reflected light rays are collectively denoted by numeral 200. As the light rays 200 are directed towards the right, they enhance the brightness on the game pieces that are placed to the right of the strip. The facets 23 can be part of an array of grooves or channels running parallel to the table rim. In order to increase the reflection, the facets 23 may have a bright color or metallic color. It should be noted that the light reflecting facets 23 shown in FIG. 4 are distributed on the upper surface of the brightness enhancing strips 13. But the reflecting facets can also located on the lower surface of the strips as shown in FIG. 5. Furthermore, the facets can be distributed on the surface in an orderly fashion as illustrated in FIG. 4, but they can be distributed in a random fashion as illustrated in FIG. 5.

FIG. 5 illustrates a plurality of light reflecting facets distributed on the lower surface of a brightness enhancing strip. FIG. 5 shows a cross section of another brightness enhancing strip 15 which comprises a plurality of facets, collectively denoted by numeral 25, for reflecting light. As light rays 110 descend upon the strip 15 from the upper right corner, some of the light rays are reflected by the facets 25 and directed towards the right. The reflected light rays, which are collectively denoted by numeral 220, can enhance the brightness on the game pieces placed to the right of the strip. It should be noted that the light reflecting facets 25 on the brightness enhancing strip 15 are located on the lower surface thereof. It is preferred that the brightness enhancing strip 15 itself is transparent or translucent so as to allow light rays descending upon the strip to reach the facets 25 efficiently for reflection. The strips 15 can be used to line the rim portion of a game table top or a mat. They can also be integral to a mat. As shown in FIG. 5, the facets are distributed in a random fashion. But they can also be distributed in an orderly fashion as those depicted in FIG. 4.

While the present invention has been disclosed in preferred forms and the drawing figures are for illustrative purposes only, it shall be understood by those skilled in the art that many modifications, additions and deletions can be made therein without departing from the scope of the invention as set forth in the appended claims.

What is claimed is:

1. A table mat having a rim portion and a center portion comprising:

a plurality of brightness enhancing strips disposed about the rim portion of said mat, said strips having an upper surface and a lower surface, said strips having a plurality of light reflecting facets for reflecting light rays towards the center portion of said mat when said mat is illuminated by at least one light source located above said mat.

2. The mat of claim 1 wherein said facets are located on the upper surface of said strip.

3. The mat of claim 1 wherein said facets are located on the lower surface of said strip, said strip being sufficiently transparent so as to allow light rays descending upon the upper surface of the strip to reach said facets for reflection.

4. The mat of claim 1 wherein said facets are distributed in an orderly fashion.

5. The mat of claim 1 wherein said facets are distributed in a random fashion.

6. The mat of claim 1 wherein said strips cover only a portion of the surface area of the mat.

7. The mat of claim 1 wherein said strips cover substantially the entire surface area of the mat.

* * * * *